US007845290B2

(12) United States Patent
Piretti

(10) Patent No.: US 7,845,290 B2
(45) Date of Patent: Dec. 7, 2010

(54) NESTING AND FOLDING TABLE

(75) Inventor: Giancarlo Piretti, Bologna (IT)

(73) Assignee: Pro-Cord Spa, Bologna (IT)

( * ) Notice: Subject to any disclaimer, the term of this patent is extended or adjusted under 35 U.S.C. 154(b) by 978 days.

(21) Appl. No.: 11/279,539

(22) Filed: Apr. 12, 2006

(65) Prior Publication Data

US 2006/0230991 A1 Oct. 19, 2006

(30) Foreign Application Priority Data

Apr. 13, 2005 (EP) ..... 05425219

(51) Int. Cl.
*A47B 3/00* (2006.01)

(52) U.S. Cl. ..... 108/115; 108/132

(58) Field of Classification Search ..... 108/115, 108/132, 6, 7, 9, 124, 123, 128, 131; 248/371, 248/166, 434, 439, 188.6, 188.7, 188.1
See application file for complete search history.

(56) References Cited

U.S. PATENT DOCUMENTS

| | | | | |
|---|---|---|---|---|
| 4,099,469 | A * | 7/1978 | Sahli | 108/115 |
| 4,196,675 | A * | 4/1980 | Cook | 108/124 |
| 5,205,223 | A * | 4/1993 | Ball et al. | 108/124 |
| 6,164,217 | A * | 12/2000 | Prendergast | 108/115 |
| 6,170,407 | B1 * | 1/2001 | Hayward | 108/50.02 |
| 6,314,892 | B1 * | 11/2001 | Favini | 108/115 |
| 6,336,414 | B1 * | 1/2002 | Stewart et al. | 108/115 |
| 6,637,352 | B1 * | 10/2003 | Thode et al. | 108/132 |
| 6,845,723 | B2 * | 1/2005 | Kottman et al. | 108/132 |
| 7,066,098 | B2 * | 6/2006 | Blasen et al. | 108/115 |
| 7,634,968 | B2 * | 12/2009 | Cornelius | 108/115 |
| 7,703,400 | B2 * | 4/2010 | Mockel | 108/115 |
| 2007/0209559 | A1 * | 9/2007 | Mockel | 108/115 |
| 2008/0295742 | A1 * | 12/2008 | Henriott | 108/6 |

FOREIGN PATENT DOCUMENTS

| | | |
|---|---|---|
| DE | 198 37 987 | 3/2000 |
| EP | 1159887 | 12/2001 |
| EP | 1308109 | 5/2003 |
| EP | 1159887 B1 * | 10/2003 |

OTHER PUBLICATIONS

EP Search Report, Application No. 05 42 5219, Dated Sep. 16, 2005.

* cited by examiner

*Primary Examiner*—José V Chen
(74) *Attorney, Agent, or Firm*—Patterson & Sheridan, L.L.P.

(57) ABSTRACT

Folding table having fixed support structure, a table-top articulated to the fixed support structure and movable between a lowered position and a raised position, and a first and a second pair of legs borne by the fixed support structure and movable between a usage position and a stowage position. The first and the second pair of legs are rotatable around respective vertical axes and are connected to the table-top by means of an actuating device which actuates the rotation of the first and of the second pair of legs as a result of the movement of the table-top from the lowered position to the raised position and vice versa.

12 Claims, 11 Drawing Sheets

NESTING AND FOLDING TABLE

CROSS-REFERENCE TO RELATED APPLICATIONS

This application claims benefit of European Patent Application No. 05425219.2, filed Apr. 13, 2005, and is herein incorporated by reference in its entirety.

BACKGROUND OF THE INVENTION

1. Field of the Invention

The present invention relates to a table comprising a fixed support structure, a table-top articulated to the fixed support structure about a horizontal axis and movable between a lowered position and a raised position, and a first and a second pair of legs borne by the fixed support structure and movable between a usage position and a stowage position.

2. Description of the Related Art

In many fields of use, there is a need for tables which, when they are not used, can be arranged in a stowage position in which the tables occupy less space than in the position of normal use. This functionality is especially appreciated in the case of tables used for parties and the like which, at the end of the event, can be put in a stowage position, e.g. to employ the space for other uses.

SUMMARY OF THE INVENTION

The object of the present invention is to provide a folding table that can be rapidly brought from the position of use to a stowage position and which, in the stowage position, can be nested with tables of the same kind to reduce the occupied space.

Another object of the present invention is to provide a table in which the passage from the position of normal use to the stowage position and vice versa can take place in particularly simple and rapid fashion.

According to the present invention, these and other objects are achieved by a table having the characteristics set out in the claims.

BRIEF DESCRIPTION OF THE DRAWINGS

The present invention shall now be described in detail with reference to the accompanying drawings, provided purely by way of non limiting example, in which.

DETAILED DESCRIPTION

Figure 1:
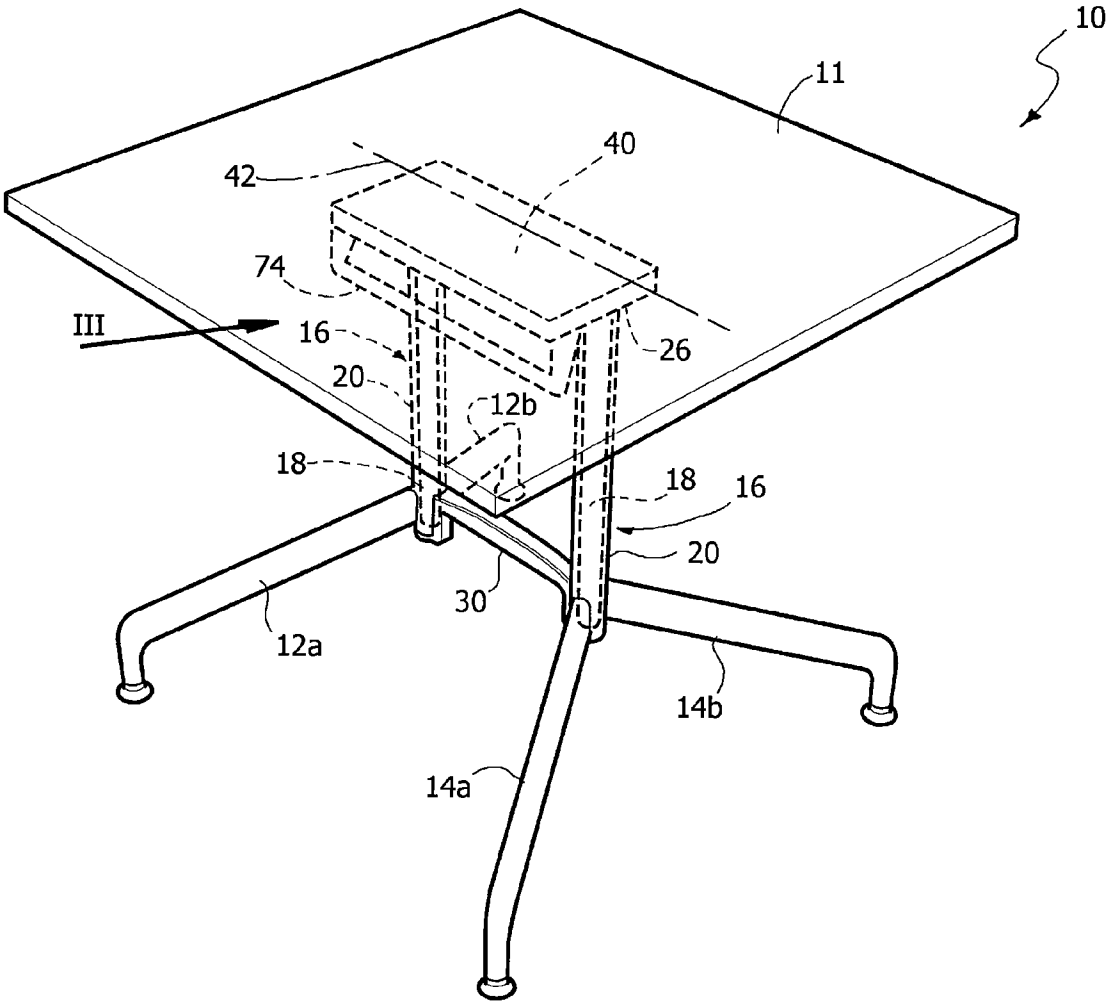
FIG. 1 is a perspective view of table according to the present invention in position of use.
Figure 2:
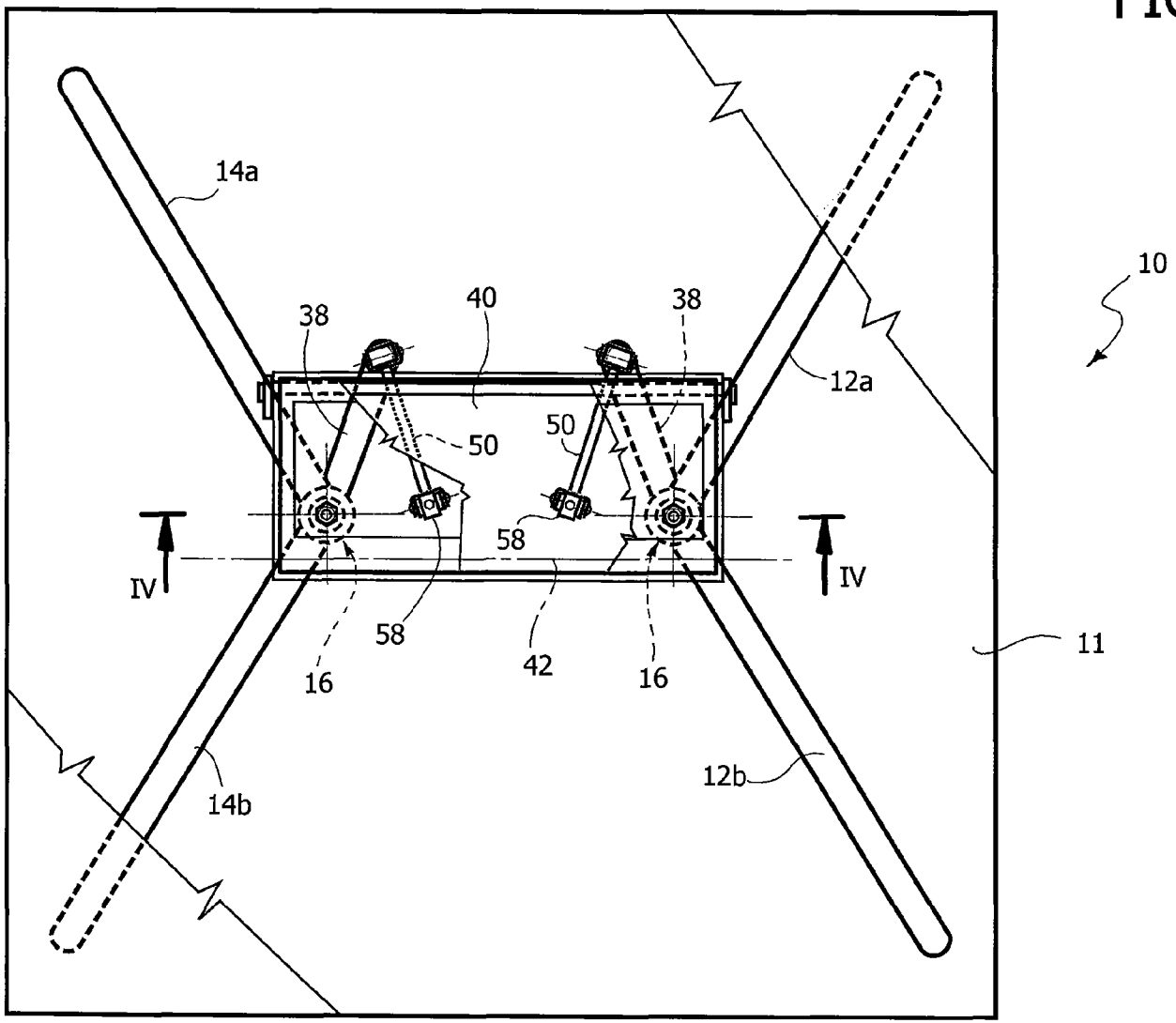
FIG. 2 is a plan view of the table of FIG. 1.

With reference to FIGS. 1 and 2, the reference number 10 designates a folding table according to the present invention. The table 10 comprises a table-top 11 which in the example illustrated in the figures has a square shape. Naturally, the top 11 may have a different shape from the one illustrated in the figures, e.g. rectangular, circular, oval, etc.

The table 10 comprises a first pair of legs 12*a*, 12*b* and a second pair of legs 14*a*, 14*b*. The legs of each pair 12*a*, 12*b* and 14*a*, 14*b* are mutually fixed. Two mutually parallel vertical uprights 16 extend in the vertical direction between the top 11 and the legs 12*a*, 12*b* and 14*a*, 14*b*.

Figure 4:
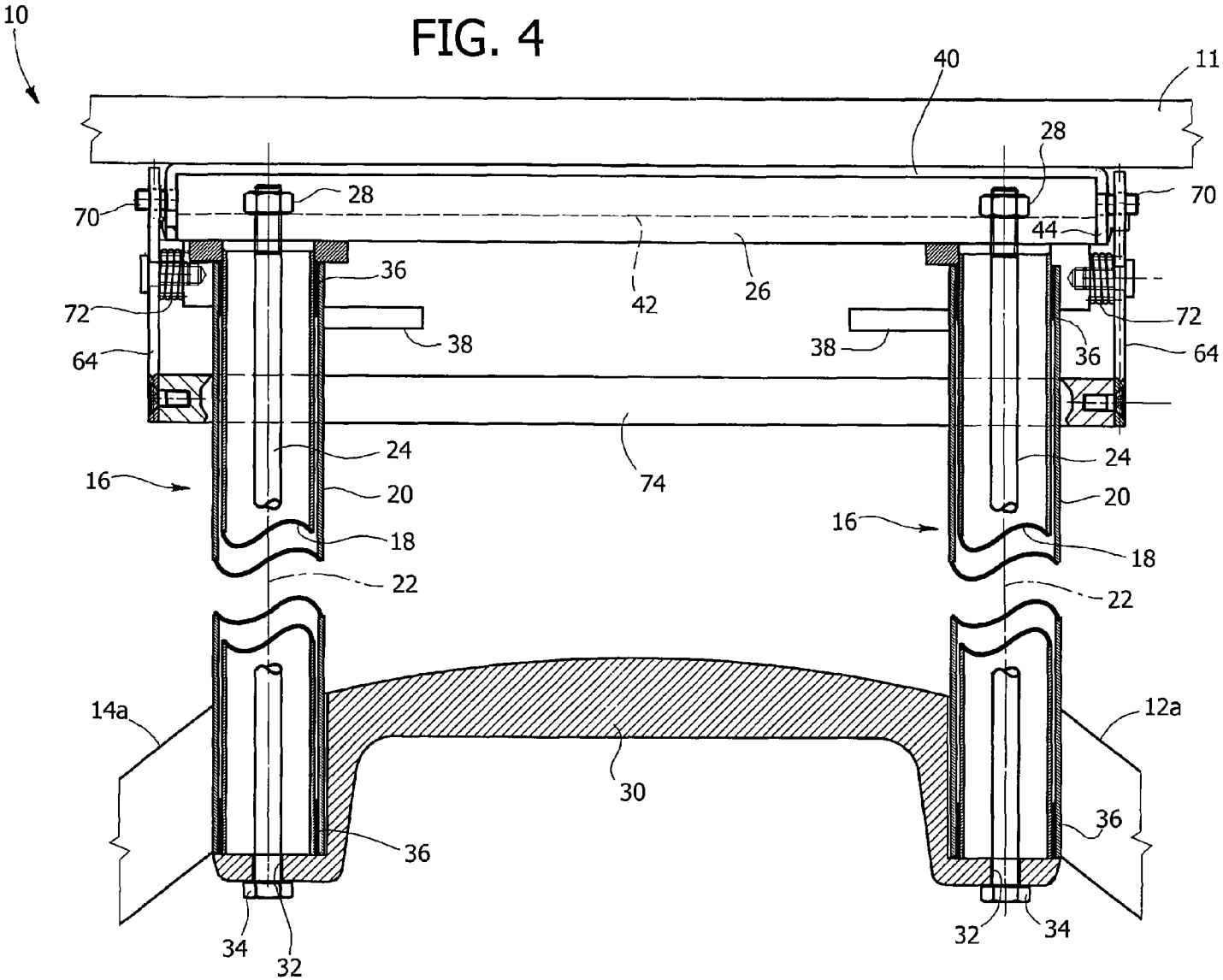
FIG. 4 is a section according to the line IV-IV of FIG. 2.
Figure 5:
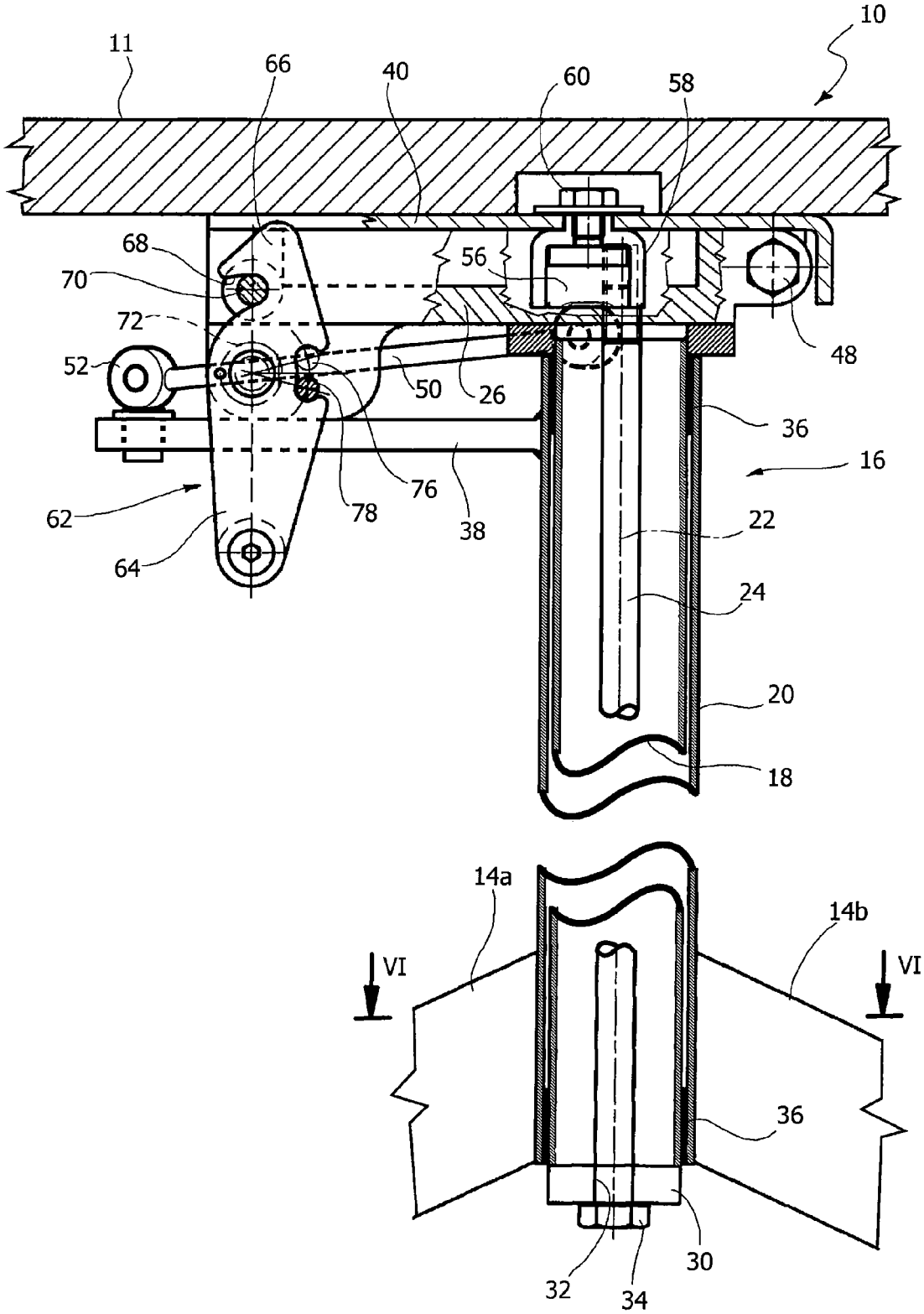
FIG. 5 is a partially sectioned view according to the arrow V of FIG. 3.
Figure 6:
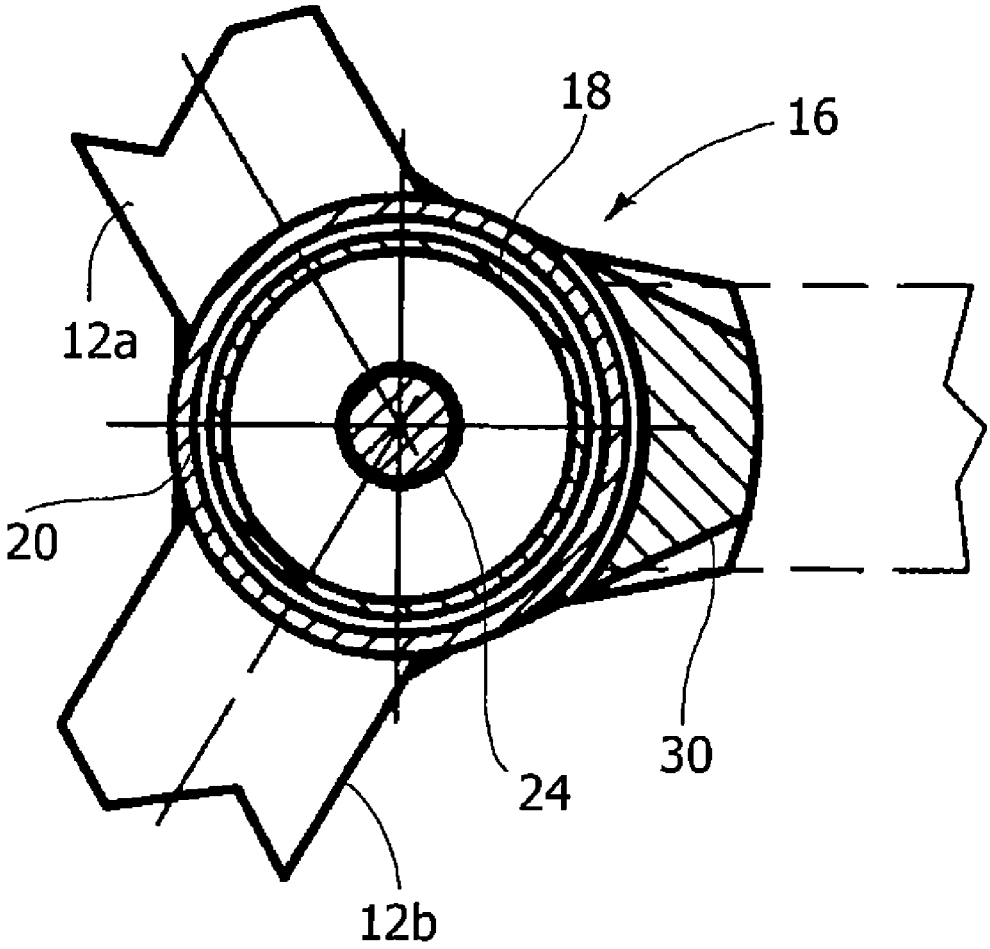
FIG. 6 is a section according to the line VI-VI of FIG. 5.

With reference to FIGS. 4 and 5, each upright 16 comprises a fixed inner tubular element 18 and an outer rotatable tubular element 20 positioned coaxial to each other. The outer tubular element 20 is mounted rotatable relative to the inner tubular element 18 around a vertical axis 22. A tie rod 24 extends within each fixed tubular element 18.

Figure 3:
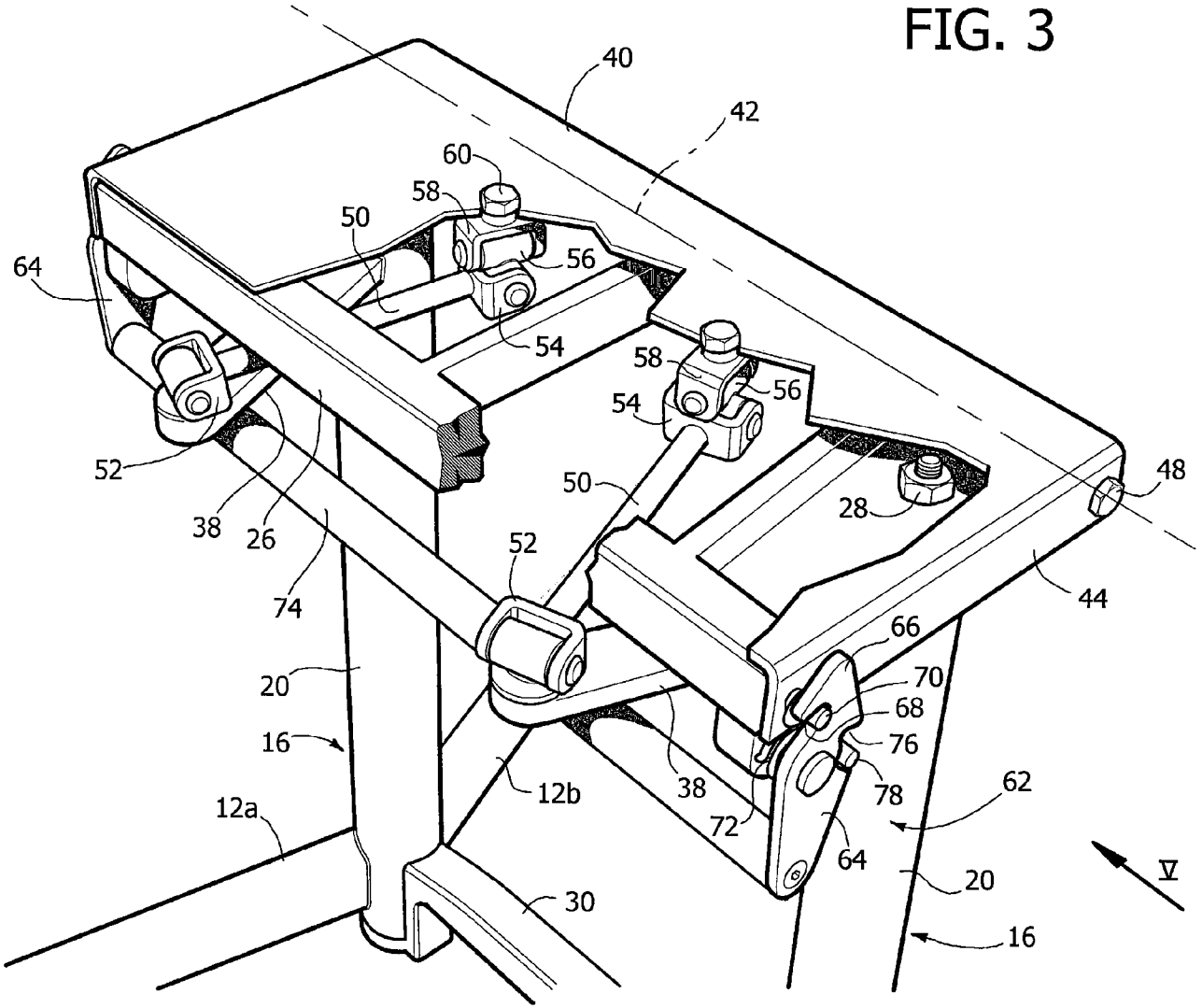
FIG. 3 is a perspective view of the part indicated by the arrow III in FIG. 1.

With reference to FIGS. 3 to 5, at the upper ends of the uprights 16 is positioned an upper support plate 26. The upper ends of the tie rods 24 are fastened to the upper support plate 26, e.g. by means of nuts 28 which engage respective threaded ends of the tie rods 24.

With reference to FIGS. 1 and 3-5, the lower ends of the uprights 16 are mutually connected by means of a transverse member 30. Each tie rod 24 extends through a hole 32 of the transverse member 30 and has a head 34 which engages a lower surface of the transverse member 30. Each tie rod 24 compresses in the axial direction the inner tubular element 18 between the lower transverse member 30 and the upper support plate 26. The two inner tubular members 18 of the two uprights 16, the tie rods 24, the transverse member 30 and the upper support plate 26 are all fixed to each other and constitute a fixed support structure of the table 10. The outer tubular element 20 of each upright 16 is connected to the inner tubular element by means of upper and lower bushings 36. Between the transverse member 30 and each outer tubular element 20, sufficient play is provided for each outer tubular element 20 to be free to rotate around the respective vertical axis 22.

The legs 12*a*, 12*b* and 14*a*, 14*b* are fastened to the lower end of a respective outer tubular element 20, e.g. by welding. To the upper end of each outer tubular element 20 is fastened, e.g. by welding, a control lever 38.

Figure 7:
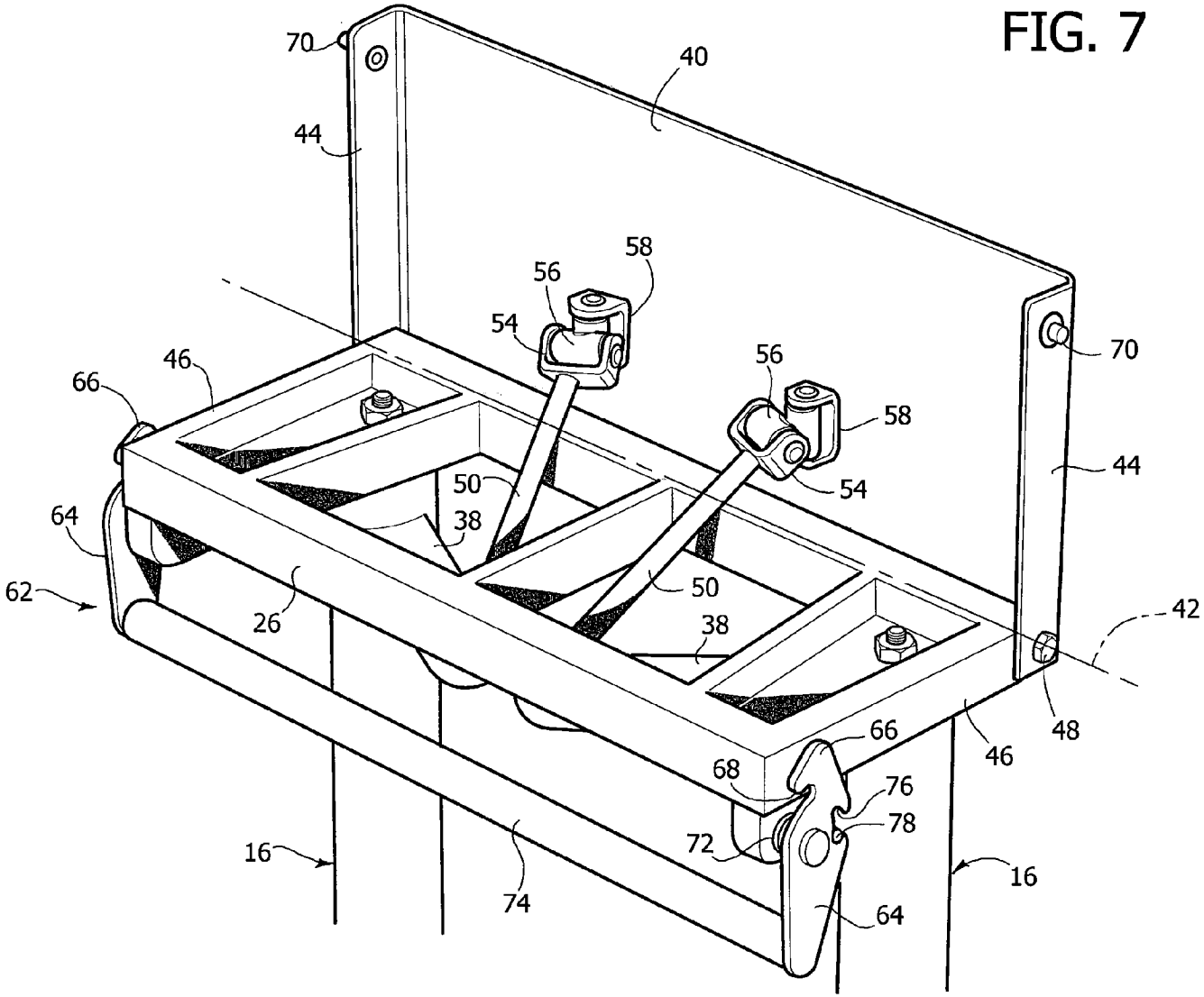
FIG. 7 is a perspective view corresponding to FIG. 3 showing the table in the stowage position.

The top 11 is fastened to an oscillating plate 40 which is articulated to the upper support plate 26 around a horizontal articulation axis 42. The plane 11 can be fastened to the oscillating plate 40 with any known system, e.g. by means of screws (not shown). The oscillating plate 40 is preferably provided with bent lateral edges 44 which co-operate in guiding relationship with corresponding end lateral edges 46 of the upper support plate 26. The articulation between the oscillating plate 40 and the upper support structure 26 can be obtained by means of screws 48 which engage corresponding holes formed in the bent edges 44, leaving the plate 40 free to oscillate around the axis 42 of the screws 48. The oscillating plate 40 has two stable positions illustrated respectively in FIGS. 3 and 7. In the position of FIG. 3, the plate 40 extends horizontally and bears on the upper support structure 26. In the position of FIG. 7, the oscillating plate 40 is rotated upwards starting from the lowered position shown in FIG. 3 by an angle equal to or smaller than 90°.

The table according to the present invention is provided with an actuating device which commands the rotation of the first and of the second pair of legs 12*a*, 12*b* and 14*a*, 14*b* around the respective vertical axes 22 as a result of the oscillation of the top 11 around the horizontal axis of oscillation 42.

With reference in particular to FIGS. 3 and 7, the actuating device comprises two connecting rods 50, each of which has a first end 52 articulated to a corresponding end of a control lever 38 and a second end 54 articulated to the oscillating plate 40. Preferably, each connecting rod is articulated to the oscillating plate 40 by means of a universal joint 56 having a flange 58 fastened to the oscillating plate 40 by means of a screw 60.

Figure 8:
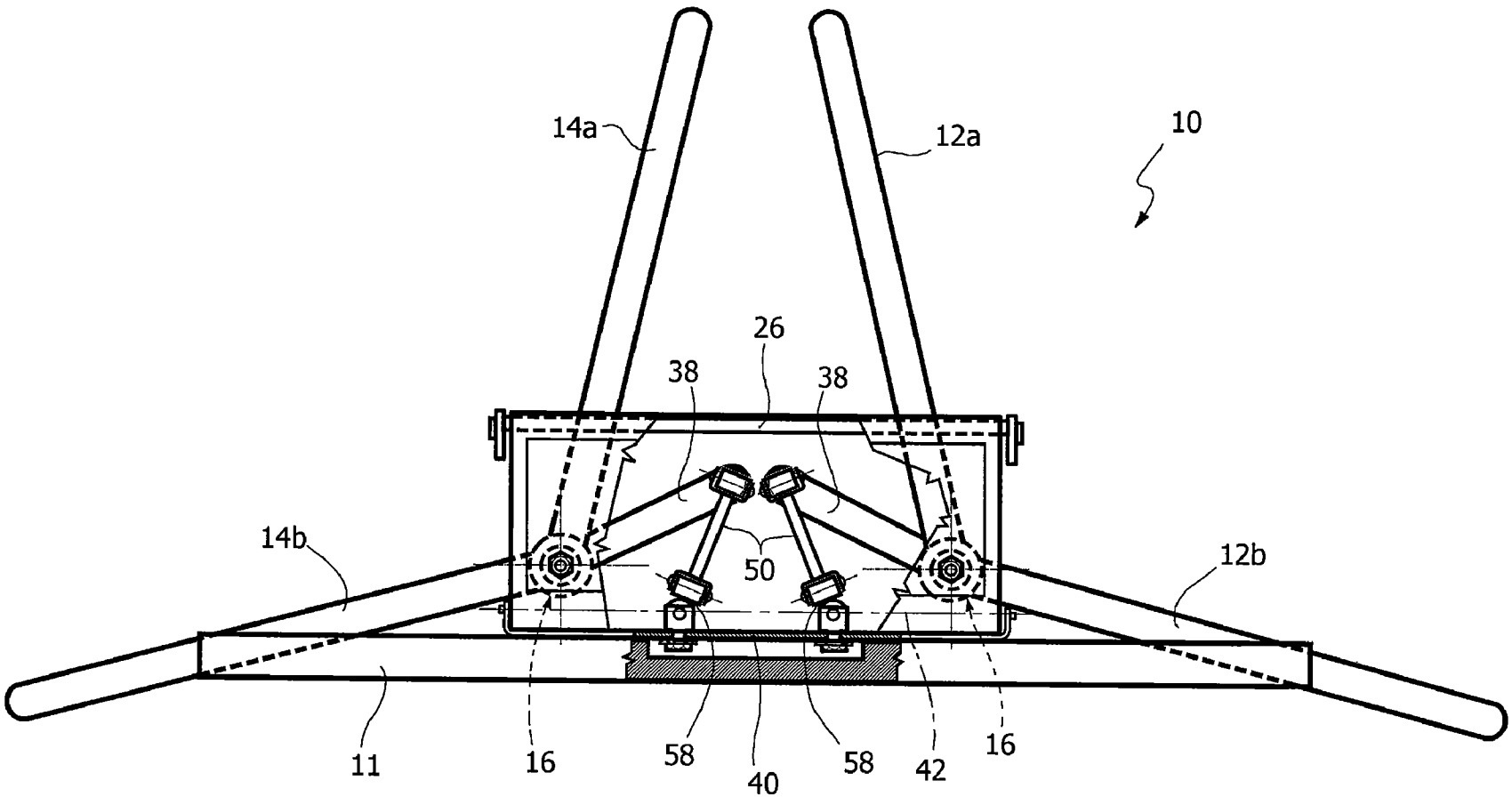
FIG. 8 is a plan view of the table according to the invention in a stowage position.

Observing the plan views of FIGS. 2 and 8, it is readily apparent that the oscillation of the top 11 (and hence of the oscillating plate 40 fastened to the lower surface of the top 11) between the horizontal position of FIG. 2 and the vertical position of FIG. 8 commands, through the connecting rods 50, a rotation of the actuating levers 38 in a horizontal plane between the position of FIG. 2 and the position of FIG. 8. Since the actuating levers 38 are fixed relative to the legs 12*a*, 12*b* and 14*a*, 14*b*, the movement of the top 11 from the horizontal position to the vertical position, and vice versa, causes the motion of the legs 12*a*, 12*b* and 14*a*, 14*b* from the position of FIG. 2 to the position of FIG. 8, and vice versa. In the position of FIG. 2 the legs 12*a*, 12*b* and 14*a*, 14*b* are arranged according to an "X" configuration, while in the configuration of FIG. 8 the legs 12*a*, 12*b* and 14*a*, 14*b* assume a general "Y" configuration, with the legs 12*a*, 14*a* forming between them an acute angle, opposite with respect to the top 11.

The angle between two mutually fixed legs 12*a*, 12*b* or 14*a*, 14*b* can be e.g. about 120°. In the configuration of FIG. 2, which is the position of normal use of the table, the angle between the legs 12*a*, 14*a* or 12*b*, 14*b* is about 60°. In the configuration of FIG. 8, the angle between the legs 12*a*, 14*a* is about 30° whilst the angle between the legs 12*b*, 14*b* is about 150°.

Figure 9:
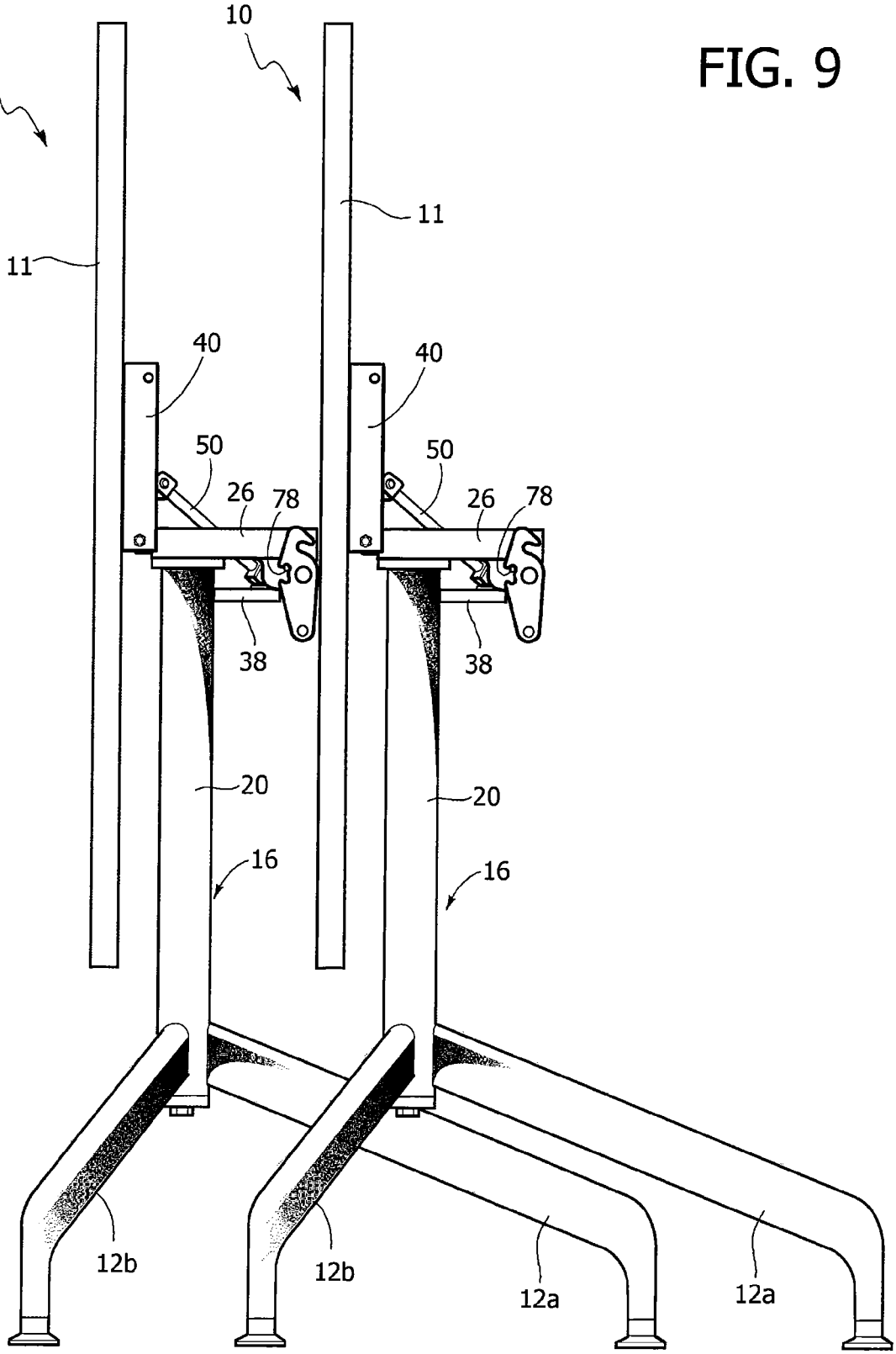
FIGS. 9 and 10 are respectively a lateral view and a plan view showing two tables according to the invention in stowage position and nested together.
Figure 10:
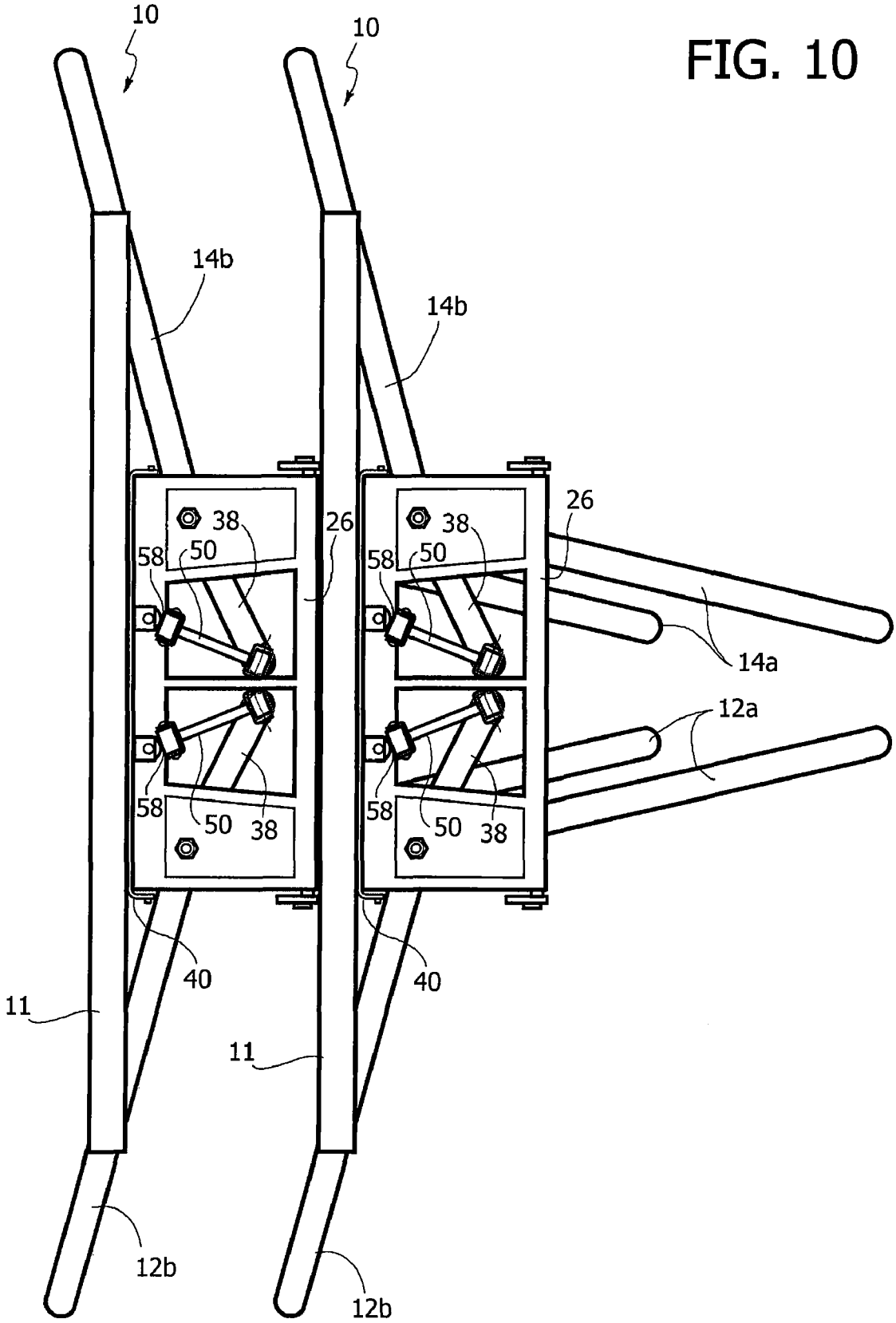

When a table 10 according to the invention is in the position of stowage, it can be nested with other tables of the same type as shown in FIGS. 9 and 10. This nesting is made possible by the fact that the top 11 extends in a substantially vertical plane and that the legs 12*a*, 14*a* of a table can be inserted into the legs 12*a*, 14*a* of a subsequent table as shown in the plan view of FIG. 10. The nesting of the tables is possible thanks to the fact that in the position of stowage the legs 12*a*, 14*a* of the tables form between them an acute angle with the vertex opposite with respect to the plane 11. The legs 12*a*, 12*b* and 14*a*, 14*b* can be provided at their ends with bearing feet as shown in the figure or with pivoting casters.

The table according to the present invention is preferably provided with a blocking device to block the top 11 in its lowered position, so that the table 11 can be brought to its raised position only after the blocking device is disengaged manually by the user.

With reference to FIGS. 3 through 5 and 7, the blocking device, globally designated by the number 62, comprises two blocking levers 64 mounted oscillating around a horizontal axis parallel to the axis 42 of articulation of the oscillating plate 40. Each of the blocking plates 64 has a head 66 with a hook portion 68 which co-operates with a respective pivot 70 projecting laterally from the respective bent edge 44 of the oscillating plate 40. The two blocking plates 64 are hinged to the upper support plate 26 and are associated to respective pin springs 72 (FIG. 4) which tend to maintain the plates 64 in the blocking position. The two plates 64 are connected to each other by means of a bar 74 which can be gripped manually by the user to disengage the blocking device. Each of the two blocking levers 64 has a seat 76 that co-operates with an end stop pivot 78 fastened to the upper support structure 26. The head 66 of each blocking lever 64 is so shaped as to bring the pivot 70 automatically in position of engagement with the levers 64 as a result of the lowering of the top from the raised position to the lowered position. To raise the top 11 starting from the lowered position, it is sufficient to unlock the blocking device 62 acting on the bar 74. Subsequently, the top 11 of the table can be rotated upwards. During the raising of the top, the legs rotate automatically as described previously, moving to the position that allows the mutual nesting of the tables.

Figure 11:
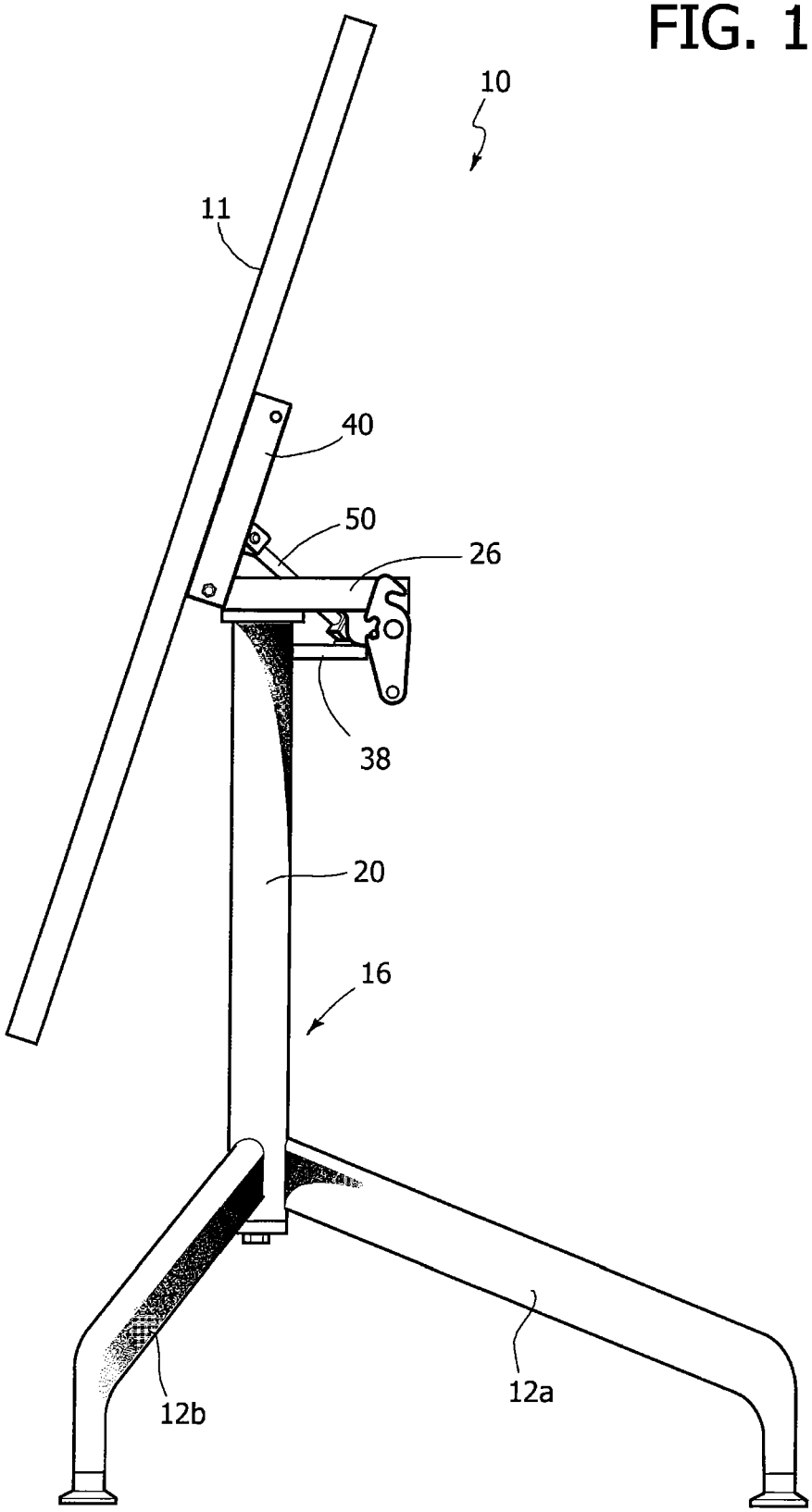
FIG. 11 is a lateral view showing a variant of the table according to the invention.

In the variant of FIG. 11, in the raised position the plane 11 is not exactly vertical. The angle between the oscillating plate 40 and the support plate 26, in the stowage position, is smaller than 90°. This arrangement allows the mutual nesting of the tables even when the table has greater dimensions.

While the foregoing is directed to embodiments of the present invention, other and further embodiments of the invention may be devised without departing from the basic scope thereof, and the scope thereof is determined by the claims that follow.

The invention claimed is:

1. A folding table comprising:

a fixed support structure, a table-top attached to an oscillating structure articulated to the fixed support structure around a horizontal axis, wherein the table-top is movable between a substantially horizontal position and a substantially vertical position, and a first and a second pair of legs borne by respective mutually parallel vertical uprights and movable between a usage position associated to the substantially horizontal position of the table-top and a stowage position associated to the substantially vertical position of the table-top, wherein the first and the second pair of legs are rotatable around respective vertical axes and each are connected to the table-top by an actuating device that includes at least one connecting rod having a first end articulated to a control lever and a second end articulated to the oscillating structure, whereby the movement of the table-top causes the rotation of the first and of the second pair of legs, and wherein each of said vertical uprights comprises a fixed inner tubular member and an outer tubular member, rotatable relative to the inner tubular member around a vertical axis, each pair of legs being fastened to a respective outer tubular member, and wherein at the upper end of each of said outer tubular members is fixedly fastened the control lever.

2. The table as claimed in claim 1, wherein the legs are arranged according to a general "X" configuration in the usage position.

3. The table as claimed in claim 1, wherein the legs are arranged according to a general "Y" configuration in the stowage position.

4. The table as claimed in claim 1, wherein the stowage position two legs form between them an acute angle with its vertex opposite with respect to the table-top.

5. The table as claimed in claim 1, wherein the inner tubular member of each upright is fastened at its upper end to an upper support plate, the inner tubular members of the two uprights being mutually connected at their lower ends by means of a transverse member.

6. The table as claimed in claim 5, wherein the lower transverse member is fastened to the upper support structure by means of two tie rods extending inside the uprights.

7. The table as claimed in 1, further comprising a blocking device able to lock the table-top in the substantially horizontal position.

8. The table as claimed in claim 7, wherein said blocking device comprises two oscillating blocking levers articulated to the upper support plate and thrust elastically in a blocking position, said blocking levers being mutually connected by means of a bar which can be operated manually by the user to unlock the table-top.

9. The table as claimed in claim 1, wherein said oscillating structure is an oscillating plate.

10. The table as claimed in claim 1, wherein the first end of the connecting rod is articulated to the control lever by means of a universal joint.

11. The table as claimed in claim 1, wherein the second end of the connecting rod is articulated to the oscillating structure by means of a universal joint.

12. The table as claimed in claim 1, wherein when the table-top is in the raised position and the first and second pairs of legs are in the stowage position, the table is capable of being nested with an homologous table having the table-top in the substantially vertical position and the first and second pairs of legs in the stowage position, the legs of the table being inserted between the legs of the homologous table.

* * * * *